US005666629A

United States Patent [19]

Kazoh

[11] Patent Number: 5,666,629

[45] Date of Patent: Sep. 9, 1997

[54] MULTIMODE PRINTER HAVING SIDEWAY PAGE INVERTER

[75] Inventor: Osamu Kazoh, Tokyo, Japan

[73] Assignee: NEC Corporation, Tokyo, Japan

[21] Appl. No.: 576,577

[22] Filed: Dec. 21, 1995

[30] Foreign Application Priority Data

Dec. 22, 1994 [JP] Japan ..... 6-320380

[51] Int. Cl.[6] ..... G03G 15/00; B65H 29/00

[52] U.S. Cl. ..... 399/401; 271/186; 347/153

[58] Field of Search ..... 355/318, 319, 355/317; 271/186, 291; 346/134; 395/111; 347/139, 153; 399/401, 402

[56] References Cited

U.S. PATENT DOCUMENTS 5,042,791 8/1991 Stemmle ..... 271/186

*Primary Examiner*—Joan H. Pendegrass

*Attorney, Agent, or Firm*—Sughrue, Mion, Zinn, Macpeak & Seas

[57] ABSTRACT

In a printer operable in a duplex print mode, a paper is once shifted sideways away from a main path, turned upside down in the widthwise direction thereof, and then returned to the main path. Hence, images printed on both sides of the paper are matched to each other in the up-and-down direction.

15 Claims, 5 Drawing Sheets

MULTIMODE PRINTER HAVING SIDEWAY PAGE INVERTER

BACKGROUND OF THE INVENTION

The present invention relates to a printer operable in a duplex print mode for printing images on both sides of a paper and, more particularly, to a printer capable of matching images formed on both sides of a paper in the up-and-down direction.

Generally, in a printer having the above capability, a paper carrying an image on one side or front thereof is conveyed to a turning section. The turning section turns the paper upside down by switching it backward. Subsequently, an image is formed on the other side or rear of the paper. The paper carrying the images on both sides thereof is driven out of the printer. However, because the conventional printer prints an image on the other side or rear of the paper after replacing the leading edge and the trailing edge thereof, the images printed on both sides of the paper do not agree with each other in the up-and-down direction.

SUMMARY OF THE INVENTION

It is therefore an object of the present invention to provide a printer operable in a duplex print mode and capable of matching images printed on both sides of a paper in the up-and-down direction.

In accordance with the present invention, a printer operable in a duplex print mode for printing images on both sides of a paper has a paper feeding section for feeding the paper to a transport path. A printing section is located on the transport path downstream of the paper feeding section, and prints an image on the paper. A turning section is located on the transport path downstream of the printing section, and turns the paper upside down. A conveying mechanism is arranged at preselected positions on the transport path. A control section sends a print command to the printing section and a convey command to the conveying mechanism. A discharging section discharges the paper after printing. The turning section has shifting members for shifting the paper away from the transport path in the widthwise direction of the paper, and returning the paper to the transport after the sheet has been turned over, and a turning mechanism for receiving the paper from the shifting members, and turning the paper upside down in the widthwise direction of the paper. The control section has a turn-over control function for sending a command to the turning section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
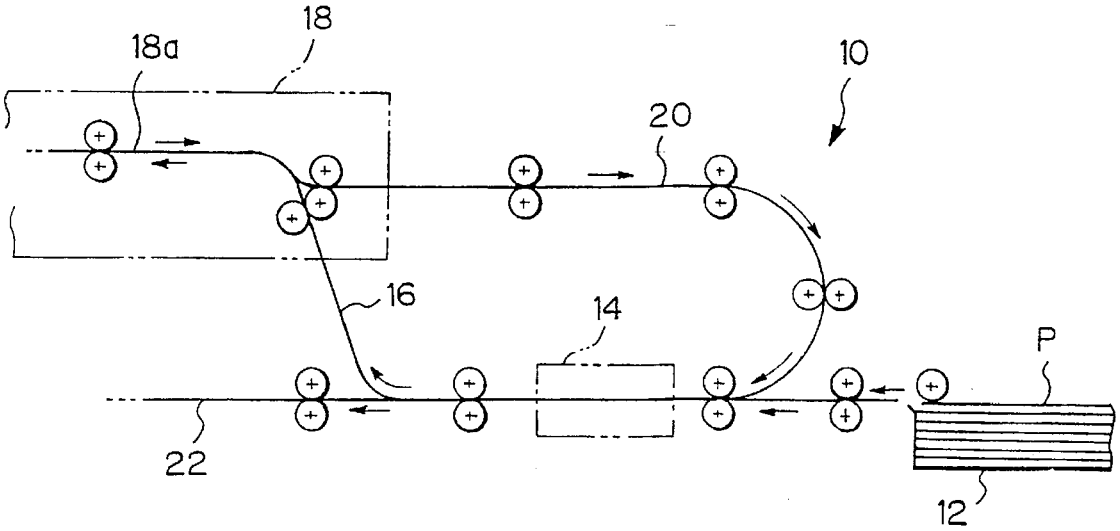
Fig. 1 PRIOR ART
FIG. 1 shows a conventional printer operable in a duplex print mode.
Figure 2:
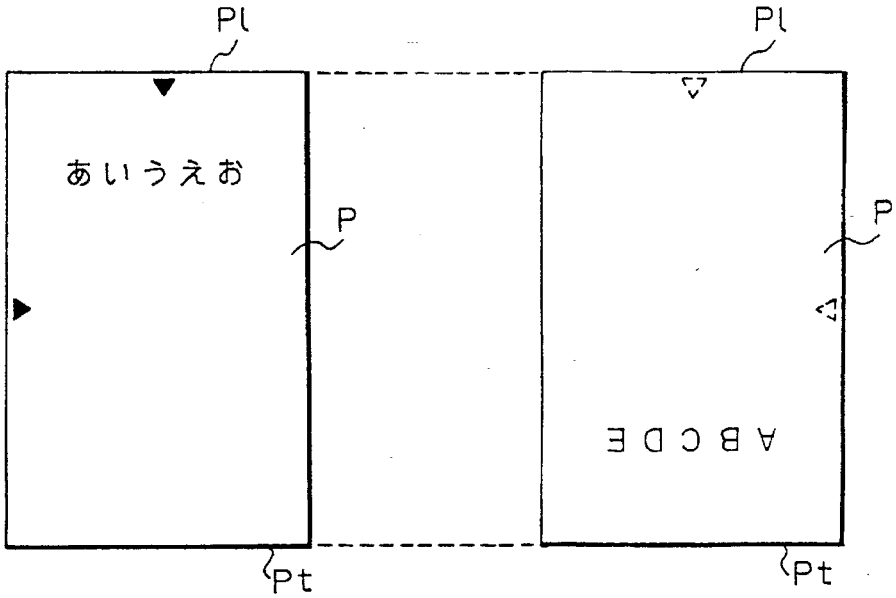
Fig. 2 PRIOR ART
FIG. 2 shows specific images printed on both sides of a paper by the conventional printer.

To better understand the present invention, a brief reference will be made to a conventional printer, shown in FIG. 1. As shown, the printer, generally 10, has a stacker 12 on which papers P are stacked. One paper P is fed from the stacker 12 toward a printing section 14 by a pick-up roller. The printing section 14 prints an image on one surface of the paper P. The paper P carrying the image thereon is conveyed to a turning section 18. The turning section 18 has a turn-over path 18*a* longer than the paper P. The paper P is driven into the turn-over path 18*a* and then driven out of the path 18*a* into a path 20 tailfirst, i.e., switched back. The paper P is again conveyed to the printing section 14 after being turned upside down by the path 20. Then, the printer prints another image on the rear of the paper P. The resulting duplex printing is driven out of the printer along a path 22. As shown in FIG. 2, the printer 10 prints an image on the other side or rear of the paper P after turning over the paper P, i.e., replacing the leading edge $P_1$ and the trailing edge Pt thereof. This brings about a problem that the images printed on both sides of the paper P do not agree with each other in the up-and-down direction, as discussed earlier.

Figure 3B:
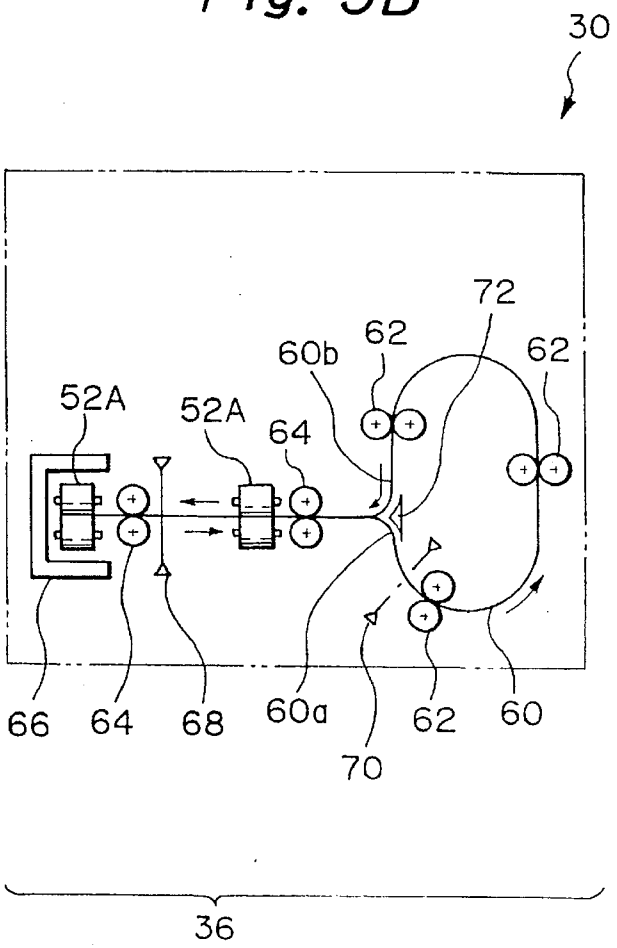
FIG. 3B is a side elevation of a turning section included in the embodiment.
Figure 3A:
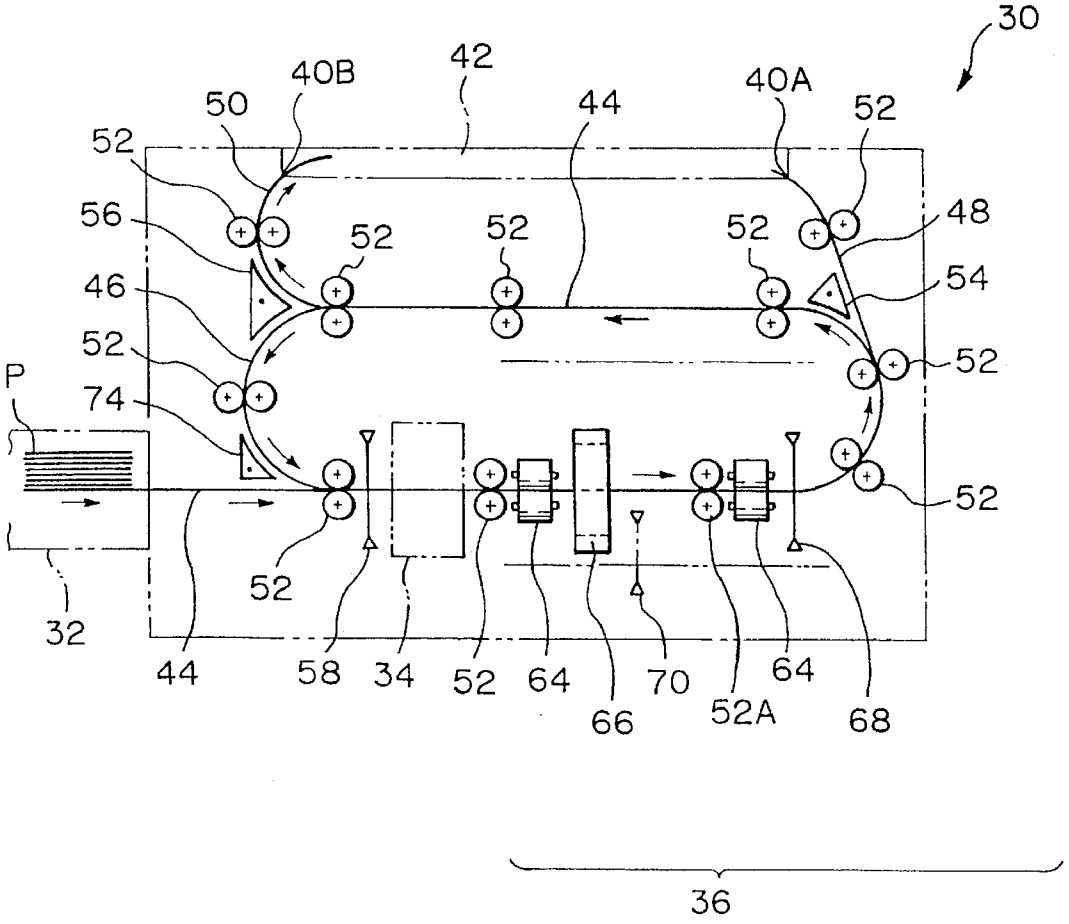
FIG. 3A is a front view showing a printer embodying the present invention and operable in a duplex print mode.

Referring to FIGS. 3A and 3B, a printer embodying the present invention is shown and generally designated by the reference numeral 30. In the figures, arrows indicate directions in which a paper P is conveyed. As shown, the printer 30 has a hopper 32 storing a stack of papers P. A printing section 34 prints images on the papers P sequentially fed thereto. A turning section 36 turns over the paper P coming out of the printing section 34 and carrying an image on one side thereof. A control section 38 (see FIG. 6) feeds a print command to the printing section 34. There are also shown paper discharging sections 40A and 40B for discharging the paper P, and a stacker 42 for stacking the discharged papers or printings P thereon. The above various sections 32, 34, 36, 40A, 40B and 42 are communicated to each other by a plurality of transport paths, i.e., a main path 44, a path 46 for a duplex print mode, a discharge path 48 for a simplex print mode, and a discharge path 50 for the duplex print mode. A plurality of roller pairs 52 and 52A are arranged along the transport paths 44–50. A gate 54 is located at a position where the discharge path 48 branches off the main path 44. The discharge path 48 terminates at the discharge section 40A assigned to the simplex print mode. The paths 46 and 50 for the duplex print mode diverge from the main path 44 at a position downstream of the gate 54. A gate 56 is located at the position where the paths 46 and 50 branch off the main path 44. The path 46 terminates at the printing section 34 while the path 50 terminates at the discharge section 40B assigned to the duplex print mode. A length sensor 58 is located on the main path 44 upstream of the printing section 34 with respect to the direction of paper transport.

The turning section 36 is implemented by a turn-over path 60 having opposite end portions 60*a* and 60*b*, a plurality of roller pairs 62, and two conveyor roller pairs 64. The roller pairs 62 constitute a turn-over conveying mechanism. The roller pairs 64 play the role of conveying means for conveying the paper P toward the path 60. A width sensor 66 is interposed between the roller pairs 64. A leading edge sensor 68 is positioned downstream of the width sensor 66. Finally, a leading edge sensor 70 and a gate 72 are arranged on the path 60.

In operation, when the control section 38 generates a paper feed command, one paper P is fed from the top of the stack in the hopper 32 to the main path 44 by a pick-up roller, not shown. The paper P is sequentially conveyed along the path 44 by the roller pairs or conveying means 52. After the length sensor 58 preceding the printing section 34 has sensed the leading edge of the paper P, the controller 38 sends a print command to the printing section 34 at a predetermined time. In response, the printing section 34 starts printing an image on one side or front of the paper P.

In the turning section 36 following the printing section 34, the two roller pairs or shifting means 64 are positioned such that they convey the paper P in the direction perpendicular to the usual direction of paper transport. The roller pairs 64 are spaced from each other by a distance not exceeding the length of the paper P. A motor 64*a* and a spacing mechanism 64*b* (see FIG. 6) are associated with the individual roller pair 64. The spacing mechanisms 64*b* each maintains the rollers of the respective roller pair 64 spaced from each other when a turning operation is not required, thereby preventing them from obstructing the paper P. When the leading edge sensor 68 senses the leading edge of the paper P, the controller 38 generates a turn-over command. In response, the spacing mechanisms 64*b* each brings the rollers of the respective roller pair 64 into contact with each other. In this condition, the motors 64*a* drive the roller pairs 64 so as to transfer the paper P from the main path 44 to the turnover path 60 sideways, i.e., in the widthwise direction of the paper P.

The roller pair 52A conveys the paper P along the main path 44 at the position where the shift roller pairs 64 start shifting the paper P sideways. A motor 52*a* and a spacing mechanism 52*b* (see FIG. 6) are also associated with the roller pair 52A. In response to the turn-over command, the motor 52*a* stops driving the roller pair 52A while the spacing mechanism 52*b* moves the rollers of the roller pair 52A away from each other.

Figure 4B:
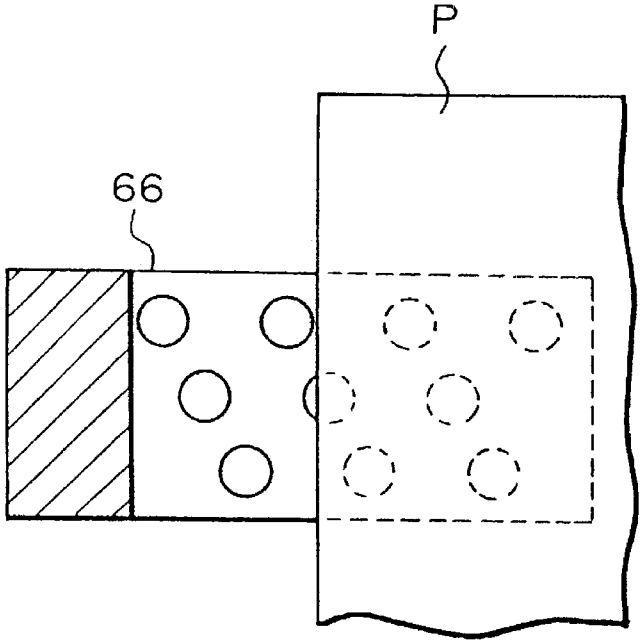
FIG. 4B is a side elevation as seen in a direction A—A of FIG. 4A.
Figure 4A:
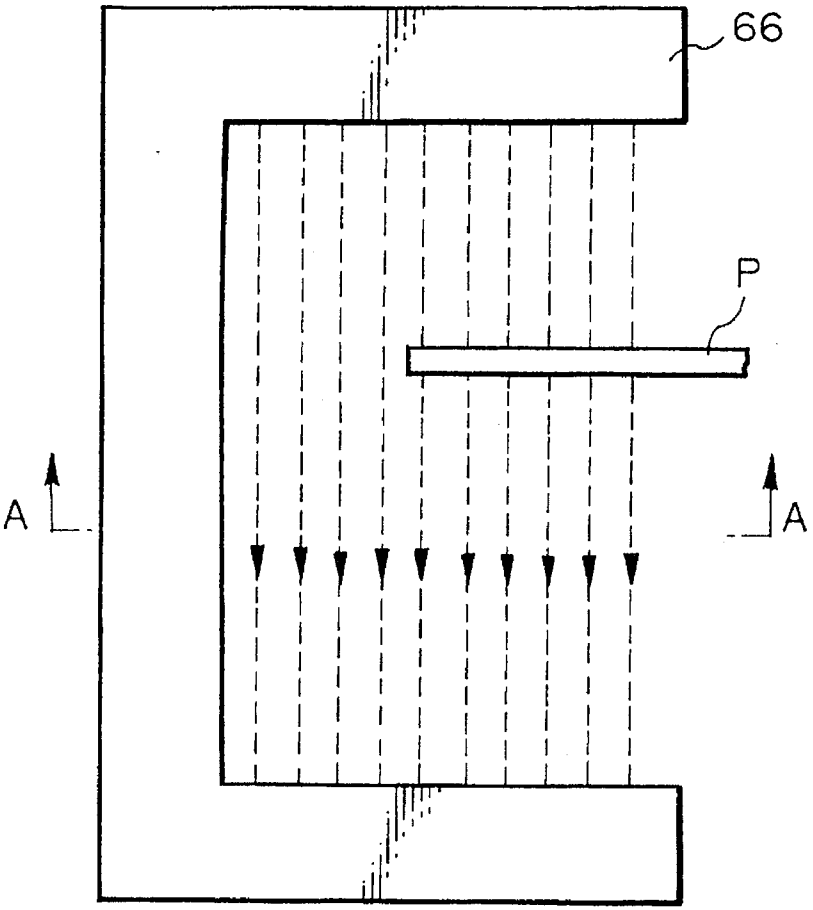
FIG. 4A is a front view of a width sensor also included in the embodiment.

Further, in response to the turn-over command, the width sensor 66 senses the side edge of the paper P. The sensor 66 is implemented as a plurality of sensors facing the paper P. As shown in FIGS. 4A and 4B, the sensors are arranged in a plurality of arrays spaced a preselected distance from each other and inclined relative to the widthwise direction of the paper P. This configuration allows a greater number of sensors to be arranged than when sensors are arranged linearly in the widthwise direction of the paper P, so that the side edge of the paper P can be detected with higher accuracy. The sensor 66 senses the side edge of the paper P so that the paper P can be shifted sideways into the turn-over path 60, turned upside down by the path 60, and then returned to the same position as before the shift to the path 60. The above position of the paper P is memorized by the control section 38.

The roller pairs 64 convey the paper P toward the gate 72 where the opposite ends 60*a* and 60*b* of the turn-over path 60 diverge from each other. Initially, the gate 72 is so positioned as to guide the incoming paper P to the end 60*a* of the path 60. However, when the tailing edge sensor 70 located on the path 60 senses the trailing edge of the paper P, the gate 72 is switched to select the other end 60*b* of the path 60 by a command fed from the control section 38. Of course, the gate 72 may select the end 60*b* prior to the end 60*a*. The trailing edge sensor 70 may be replaced with a sensor responsive to the leading edge of the paper P.

As shown in FIG. 3B, the paper P entering the turn-over path 60 is guided to the end 60*a* of the path 60 by the gate 72, conveyed by the roller pairs 62 along the path 60, and then returned to the roller pairs 64 via the other end 60*b* of the path 60. As a result, the paper P is turned upside down by the path 60. The roller pairs 64 return the paper P to the main path 44 in the same direction as they shifted it away from the path 44. Specifically, the control section 38 drives the motors 64*a* such that the roller pairs 64 return the paper P sideways to substantially the same position as before the turnover, based on the position of the paper P sensed by the width sensor 66. Thereafter, the spacing mechanisms 64*b* move the rollers of the associated roller pairs 64 away from each other. At the same time, the rollers of the roller pair 52A are brought into contact in order to convey the paper P.

In the duplex print mode, the guide 54 is so positioned as to select the main path 44 and not the discharge path 48 for the simplex print mode which branches off. Then, the gate 56 guides the paper P into the path 46 assigned to the duplex print mode. As a result, the paper P is again brought to the printing section 34 via the main path 44 into which the path 46 merges. The gates 54 and 56 are each configured to swing in the right-and-left direction (or the up-and-down direction) in response to a command from the control section 38, thereby guiding the paper P with its edge. In FIG. 3A, the reference numeral 74 designates a guide for guiding the paper P.

Figure 5:
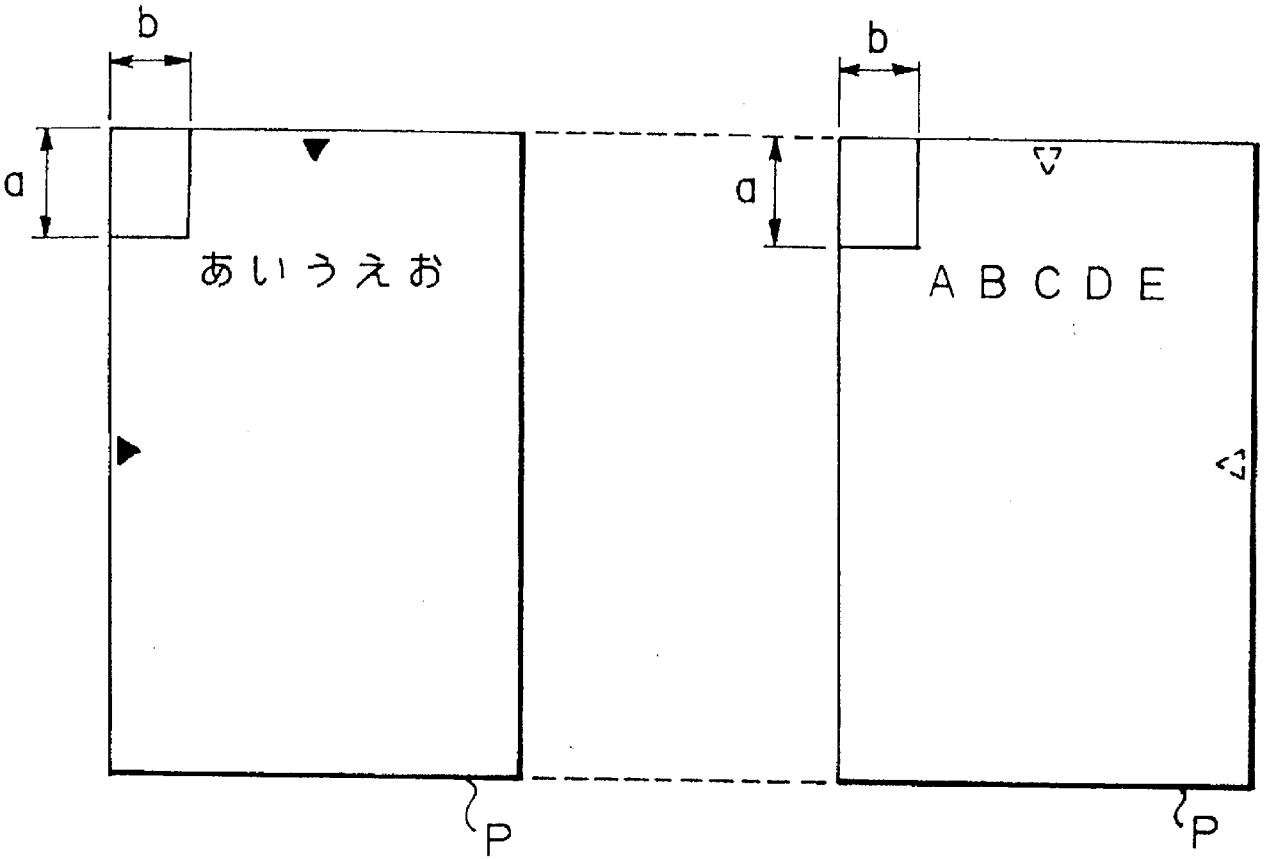
FIG. 5 shows specific images formed on both sides of a paper by the embodiment.

When the length sensor 58 preceding the printing section 34 senses the leading edge of the paper P, the control section 38 again sends a print command to the section 34 at the same timing as during the front printing. In response, the printing section 34 prints an image on the other side or rear of the paper P. Hence, the images printed on both sides of the paper P agree with each other in the lengthwise direction. In addition, because the paper P has been positioned by the turning section 36 with respect to the front and rear, the two images coincide in the widthwise direction of the paper P. FIG. 5 shows specific images printed on both sides of the paper P. As shown, both images are spaced from the edge of the paper P by the same distance a in the lengthwise direction, and spaced from the side edge by the same distance b.

The paper P carrying the images on both sides thereof are conveyed along the main path 44 past the turning section 36. At this instant, although the leading edge sensor 68 again senses the leading edge of the paper P, the paper P is simply passed through the turning section 36. This can be done if the control section 38 is so constructed as to output the turn-over command in response to every other output of the sensor 68. Alternatively, a paper sensor may be located at a suitable position on the path 46 assigned to the duplex print mode, in which case the turning section 36 will be held inoperative in response to the output of the paper sensor.

The paper or duplex printing P moving away from the turning section 36 is guided by the gate 54 to the main path 44, and the guide by the gate 56 to the discharge path 50 which terminates at the discharge section 40B. The paper P is driven out to the stacker 42 via the discharge section 40B. The gate 56, like the turning section 36, may be caused to guide the paper P alternately to the paths 46 and 50 by the control section 38. Again, a sensor may be located on the path 46, if desired.

In the simplex print mode, the paper P fed from the hopper 32 to the main path 44 by the pick-up roller is conveyed to the printing section 34 by the roller pair 52. After an image has been printed on one side or front of the paper P, the paper P is conveyed to the gate 54 via the turning section 36. The gate 54 guides the paper P to the discharge path 48 assigned to the simplex print mode. As a result, the paper P is driven out to the stacker 42 via the discharge section 40A.

Figure 6:
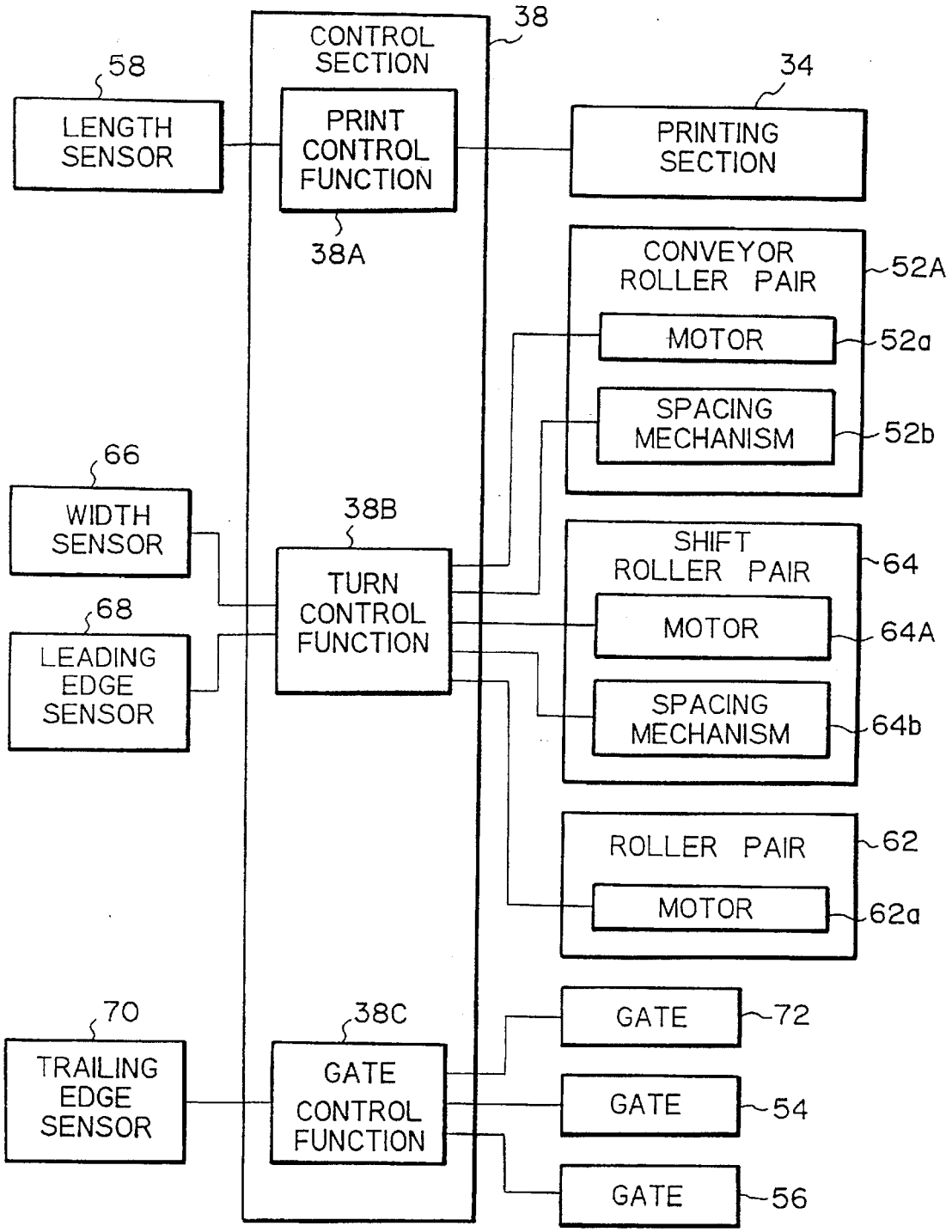
FIG. 6 is a block diagram schematically showing a control section included in the embodiment.

As shown in FIG. 6, the control section 38 has a print control function 38A, a turn control function 38B, and a gate control function 38C. The print control function 38A sends the print command to the printing section 34 in response to the output of the length sensor 58 responsive to the leading edge of the paper P. The turn control function 38B sends, in response to the output of the leading edge sensor 68, the commands to the drive motor 64*a* and spacing mechanism 64*b* associated with the roller pair 64, the motor 52*a* and spacing mechanism 52*b* associated with the roller pair 52A, and the motor 62*a* associated with the roller pair 62. In addition, the function 38B stores the widthwise position of the paper P sensed by the sensor 66 before the turn-over, and then drives the motor 64*a* in such a manner as to return the paper P to the above position after the turn-over. The gate control function 38C switches the gate 72 in response to the output of the trailing edge sensor 70. Also, the function 38C switches the gate 54 in response to a simplex print command or a duplex print command entered on an operation panel, not shown. Regarding the control over the gate 56, the function 38C may be such that the control section 38 sends a switch command to the gate 56 in response to the output of the previously mentioned paper sensor provided on the path 46. Alternatively, the control section 38 may include a counter for counting the print commands, and send a switch command to the gate 56 on the basis of the number of print commands.

The printer 30 is selectively operable in the simplex print mode or the duplex print mode. When the simplex print mode is selected on, e.g., the operation panel of the printer 30, the turning section 36 is held inoperable while the gate 54 is so positioned as to guide the paper P to the discharge path 48.

In the duplex print mode, the embodiment causes the paper P to make half a turn about the lengthwise axis thereof, i.e., about the direction of paper transport. Hence, it is possible to match the images on both sides of the paper P in the up-and-down direction. In addition, the images on both sides of the paper P are matched to each other in the lengthwise direction and widthwise direction due to the width sensor 66 included in the turning section 36.

In the embodiment, simplex printings and duplex printings are driven out via the respective discharge sections 40A and 40B, and are therefore stacked independently of each other.

The operation panel may be provided with a function of accepting a paper size command. Then, when a desired paper size is entered on the panel, the controller 38 will cause each of the printing, conveying and turning operations to occur at a timing matching the paper size.

In the illustrative embodiment, the paper P carrying an image on the front thereof is turned over, and then returned to the printing section 34 via the path 46. Alternatively, the paper P turned over may be conveyed in the reverse direction, i.e., returned toward the printing section.

The various sensors included in the printer 30 may be implemented by transmission type sensors, reflection type sensors, or microswitches, as desired.

Further, while the paper P has been shown and described as being turned over by being conveyed along the path 60, it may be done by being held by retaining means and then turned together with the retaining means about the lengthwise axis.

In summary, it will be seen that the present invention provides a printer capable of obviating a duplex printing which is difficult to read due to the disagreement of images printed on both sides thereof and unavoidable with a conventional printer. This unprecedented advantage is derived from a unique configuration in which a paper is shifted sideways away from a main path, turned upside down in the widthwise direction, and then returned to the main path. This prevents inversion in a duplex print mode, i.e., the images on both sides of the printing from differing from each other in the up-and-down direction. In addition, the printer includes various sensors in order to prevent the opposite images from being dislocated in the event of the turn-over or the printing on the rear of the paper.

Various modifications will become possible for those skilled in the art after receiving the teachings of the present disclosure without departing from the scope thereof.

What is claimed is:

1. A printer operable in a duplex print mode for printing images on both sides of a paper, comprising:

a paper feeding section for feeding the paper to a transport path;

a printing section located on said transport path downstream of said paper feeding section, and for printing an image on the paper;

a turning section located on said transport path downstream of said printing section, and for turning the paper upside down;

conveying means arranged at preselected positions on said transport path;

a control section for sending a print command to said printing section and a convey command to said conveying means; and a discharging section for discharging the paper after printing;

said turning section comprising:

shifting means for shifting the paper away from said transport path in a widthwise direction of the paper, and returning the paper to substantially the same location in said transport path after the sheet has been turned over; and a turning mechanism for receiving the paper from said shifting means, and turning the paper upside down in the widthwise direction of the paper;

said control section having a turn-over control function for sending a command to said turning section.

2. A printer as claimed in claim 1, wherein said turning mechanism comprises a turn path diverging from a destination of said shifting mechanism, and U-turning to the destination, and a turn-over conveying mechanism arranged along said turn path.

3. A printer as claimed in claim 1, further comprising a width sensor located at a position where said shifting means starts shifting the paper, and for sensing a widthwise edge of the paper, wherein said control section controls said shifting means in response to an output of said width sensor such that said shifting means returns the paper to a position substantially the same position as a position before a shift.

4. A printer as claimed in claim 1, further comprising a length sensor located at a printing position of said printing section, and for sensing a lengthwise edge of the paper, wherein said control section controls said printing section in response to an output of said length sensor such that the printing position remains constant in a lengthwise direction of the paper.

5. A printer as claimed in claim 1, wherein said conveying means includes bi-directional conveying means for moving said paper between said printing section and said turning section.

6. A printer as claimed in claim 1, wherein said turning section is located immediately adjacent to said printing section along the transport path.

7. A printer operable in a duplex mode for printing images on both sides of a paper conveyed lengthwise from a feeder to a printer by way of a transport path, comprising:

a feeding section for feeding the paper to a transport path;

a printing section for printing an image on the paper;

a turning section for turning the paper upside down; and a conveyor arranged along said transport path;

wherein said printing and turning sections are located along said transport path and said turning section includes a turning mechanism having an initial position;

and said turning mechanism turns the paper upside down in the widthwise direction and returns the paper substantially to said initial position.

8. A printer as claimed in claim 7, wherein said turning section shifts said paper widthwise along a turnover path.

9. A printer as claimed in claim 7, further comprising at least one of a width sensor for sensing a widthwise edge of said paper and a length sensor for sensing a lengthwise edge of said paper at said initial position in the transport path.

10. A printer as claimed in claim 9, further comprising a control mechanism which adjusts the conveyor after turning the paper, such that at least one of said width and length sensors indicates that the paper is relocated substantially at said initial position in the transport path.

11. A printer as claimed in claim 7, further comprising a plurality of sensors and a control section, which includes controls for feeding, conveying, turning and discharging said paper, in coordination with said plurality of sensors, such that the paper passing between the turning and printing sections remains aligned in a width direction, and said printing section starts printing an image on a second side of said paper at substantially the same location as printed on a first side, for a predetermined range of widths and lengths of said paper.

12. A printer as claimed in claim 7, wherein said conveyor transports said paper into said printing section in either a forward or a reverse lengthwise direction.

13. A printer as claimed in claim 7, wherein said transport path comprises a printer section capable of printing in a forward or a reverse direction:

wherein said conveyor includes bi-directional conveying means providing a forward path and a reverse path;

wherein said paper is printed on a first side, conveyed to said turning section, turned upside down widthwise, conveyed again to the printing section and printed on a second side; and wherein said forward path conveys a leading edge of the paper from the turning section along a forward path to the printing section, and said reverse path carries a trailing edge of the paper from the turning section to the printing section;

whereby an image on said second side is printed beginning from either the leading edge or the trailing edge of the paper.

14. A printer as claimed in claim 7, wherein said turning section further comprises a paper retaining means for holding the paper while said turning means turns both the paper and said retaining means upside down about a lengthwise axis before said retaining means releases the paper.

15. A printer as claimed in claim 7 further comprising a control section which adjusts said printing, conveyor and turning sections according to a desired paper size.

* * * * *

UNITED STATES PATENT AND TRADEMARK OFFICE

CERTIFICATE OF CORRECTION

PATENT NO. : 5,666,629
DATED : September 9, 1997
INVENTOR(S) : Osamu Kazoh

It is certified that error(s) appears in the above-identified patent and that said Letters Patent is hereby corrected as shown below:

IN THE ABSTRACT

Delete the Abstract in its entirety, and insert --A printer system operable in a duplex print mode in which the paper is fed lengthwise through a printing station, along a main transport path. A page to be turned over before printing the second side is then shifted sideways into a turnover path, rotated halfway around the lengthwise axis, and returned to the same position in the main path, but upside down. The paper may then be conveyed lengthwise in either direction on a transport path back to the printing station, resulting in images on the two sides having a matching top edge or optionally reversed head to toe.--.

Signed and Sealed this

Third Day of February, 1998

*Attest:*

BRUCE LEHMAN

*Attesting Officer*

*Commissioner of Patents and Trademarks*